US005704293A

United States Patent [19]

Koivisto et al.

[11] Patent Number: 5,704,293

[45] Date of Patent: Jan. 6, 1998

[54] LIFTING DEVICE FOR MANIPULATING A TRACK ELEMENT

[75] Inventors: Seppo Koivisto, Parkano; Einari Venäläinen, Karhula; Timo Mustasilta, Karvia, all of Finland

[73] Assignee: Insinooritoimisto Desec Oy, Tampere, Finland

[21] Appl. No.: 545,758

[22] PCT Filed: May 6, 1994

[86] PCT No.: PCT/FI94/00175

§ 371 Date: Nov. 7, 1995

§ 102(e) Date: Nov. 7, 1995

[87] PCT Pub. No.: WO94/26978

PCT Pub. Date: Nov. 24, 1994

[30] Foreign Application Priority Data

May 7, 1993 [FI] Finland ..... 932066

[51] Int. Cl.[6] ..... E01B 27/17; E01B 29/04; E01B 29/16

[52] U.S. Cl. ..... 104/7.1

[58] Field of Search ..... 105/455; 104/33.5, 104/7.1; 414/459, 460

[56] References Cited

U.S. PATENT DOCUMENTS

| | | | |
|---|---|---|---|
| 4,249,467 | 2/1981 | Theurer et al. . | |
| 4,516,503 | 5/1985 | Boccaletti . | |
| 5,127,333 | 7/1992 | Theurer | 104/2 |
| 5,127,335 | 7/1992 | Whitaker, Jr. . | |
| 5,172,637 | 12/1992 | Theurer | 104/7.1 |

FOREIGN PATENT DOCUMENTS

| | | |
|---|---|---|
| 23 09 930 | 8/1974 | Germany . |
| 34 19 240 | 12/1984 | Germany . |

*Primary Examiner*—Robert J. Oberleitner
*Assistant Examiner*—C. T. Bartz
*Attorney, Agent, or Firm*—Pollock, Vande Sande & Priddy

[57] ABSTRACT

A lifting device for manipulating a track element at a manipulating location at least partially above a track transported to a manipulating location on a transport platform of a transport vehicle and includes a lifting device frame provided with power and drive system. Lifting elements are supported by the lifting device frame, for lifting the track element and transfer elements for moving the lifting device frame. At least one pair of support members supports and manipulates the transfer elements. The support members are mounted on a common subframe and at least one brace element is provided for movably mounting the common subframe to the lifting device frame, to allow the subframe to tilt and rotate with respect to the lifting device frame. Each of the support members has telescopic arms, movable between a retracted position in which the transfer elements are retractable upon the transport platform and an extended position in which the transfer elements are extended beyond the transport platform. Each of the support members has elevating members operating in a vertical direction, for moving the transfer elements in a vertical direction to change at least ground clearance of the transfer elements; and directional elements for rotating the transfer elements in a substantially horizontal plane for changing the traveling direction of the lifting device.

8 Claims, 4 Drawing Sheets

LIFTING DEVICE FOR MANIPULATING A TRACK ELEMENT

FIELD OF THE INVENTION

The present invention relates to a lifting device for manipulating a track element. The lifting device is adapted for transport to a manipulating location on a transport platform. The platform is included in a transport vehicle intended for handling a track element at the manipulating location at least partially above the track in both vertical and horizontal direction by means of lifting elements and transfer elements. Such elements are included in a lifting device frame and operated by an auxiliary force, preferably a pressure medium. The frame is further provided with power and drive means. Such as a hydraulic gear and a control center or the like. The frame is fitted with at least one, and preferably two pairs of support members. Which are successive in the longitudinal direction of the frame. The support members are extensible in the transverse direction of the frame and are provided with transfer elements, such as wheels, crawlers, or the like for maneuvering the frame on the ground. As a result of the extending the support members, the frame is fitted with substantially transverse telescopic arms situated successively in the longitudinal direction of the frame. In the transport condition, the transfer elements included in the lifting device mounted on a transport platform are retractable essentially upon the transport platform and extensible substantially beyond the transport platform for the operating condition.

BACKGROUND OF THE INVENTION

A lifting device partially of the above type is known from the published application DE-2309930. This publication discloses a lifting device which is provided with a single pair of parallel crawlers operable in the vertical direction relative to the lifting device. The lifting elements of this particular lifting device further include separate lifting cylinders for solidly supporting the lifting device on the ground for lifting operations or lateral transfer operations. The lifting device further includes flanged wheels for carrying the lifting device on a track, e.g. for bringing it to a manipulating location. The flanged wheels further provide a support for a track element to be handled during the manipulation thereof. The published application DE-3419240 discloses a lifting device slightly different from that described above, which is particularly intended for transport to a manipulating location on a transport platform included in a trackbound transport vehicle. In the transport operation, the crawlers of a lifting device mounted on the transport platform are retractable upon the transport platform and extensible beyond the transport platform for the manipulating operation.

U.S. Pat. No. 5,127,335 discloses a lifting device distinctively different from those described above, wherein the support members are fastened at their ends in an articulated fashion to a frame located on the center axis of the lifting device. The support members include crawlers adapted to be pivotable in horizontal plane. In addition, the lifting device frame is provided in its mid-section with a pivot joint, thereby enabling turning of the lifting device ends in the longitudinal direction to a certain angle relative to each other.

The solution disclosed in the published application DE-2309930 comprises a pair of crawlers coupled directly to a frame carrying the track elements. Thus, the handling of even the most common track elements requires the use of two successive lifting devices which, of course, further requires a linkage between the lifting devices for their synchronized operation. The synchronization of separate lifting devices, e.g. for operating the same at sufficiently matching speeds, may cause major problems as is well known in the art. In addition, the directional stability of the above type of solutions, especially when using two separate lifting devices, is questionable and, thus, the transfer of a track element to be manipulated e.g. in a given longitudinal direction, requires continuous surveillance and correction of the advancing direction. The control of lifting devices of the above type in the advancing direction is conventionally effected in such a manner that the parallel crawlers are operated at relatively different speeds. Thus, when controlling the first of the two separate successive lifting devices, the second lifting device must be controlled a way that corresponds to the first one. In practice, such control is impossible to perform sufficiently well due to technology, surrounding conditions etc., since both the lifting devices and the manipulated track element are subjected to stresses.

In the lifting device set forth in the published application DE-3419240, the pairs of crawlers are movably mounted on their own chassis which are connected thereabove by a lengthwise frame supporting the track elements. The high position of the frame may impair stability of the device and handling of the track elements.

In the solution set forth in the above-mentioned U.S. Pat. No. 5,127,335, the pair of crawlers mounted successively in the longitudinal direction is coupled integrally to a common frame. However, the solution described in the cited patent is not very beneficial in practice, since the support members are in an articulated fashion connected by the ends thereof to the frame; thus, the support members and the articulations are subjected to major moments of force. A pivot joint provided in the middle of the frame of a lifting device is preferred in the sense that it enables the self-operated positioning of especially the trailing pair of crawlers upon the manipulation of a track element. In practice, the controllability of this particular solution is probably questionable due to the articulation of support members. Thus, for example, the setting of support members included in the frame in alignment with each other in the same position requires high precision from individual actuators controlling the support members. Even a minor relative angular change in the support members requires continuous corrective measures for maintaining a desired traveling direction when operating the lifting device in longitudinal direction.

SUMMARY OF THE INVENTION

The lifting device of this invention has the object of providing a decisive improvement over the above-mentioned drawbacks. To fulfill this object, the lifting device of the invention is principally characterized in that at least one pair of support members is mounted on the lifting device by means of a common subframe which is movably mounted on the frame of the lifting device for enabling a joint action, such as a tilting action and/or a rotating action, for the pair of support members.

The most important benefits gained by the lifting device of the invention include the simplicity of its construction and operation and reliability in operation. The lifting device enables the manipulation of track elements conveniently in contact with the track whereby the lifting device can be lowered by means of its own lifting elements from its supporting transport platform directly into contact with the track. The capacity of the lifting device can be dimensioned optimally as the lifting and transfer actions are effected in a preferred manner; thus, the lifting device is not required to have excessive capacity which would be a result of unfavorable moments and lifting actions. Especially, when using a lifting device provided in longitudinal direction with two successive pairs of support members, the operation of the lifting device will be ideal, for example, in terms of controllability since, depending on conditions, the rearward pair is capable of positioning itself self-sufficiently upon the manipulation of a track element. Thus, the lifting device of the invention enables the manipulation of track elements while in contact with the track in such a manner that, on the one hand, a track element can be readily transferred e.g. longitudinally or transversely of the track and, on the other hand, it can be moved vertically or in horizontal plane by seating the lifting device solidly on the ground.

The invention will be described in detail with reference to the accompanying drawings, in which:

DETAILED DESCRIPTION OF THE PREFERRED EMBODIMENT(S)

Figure 1:
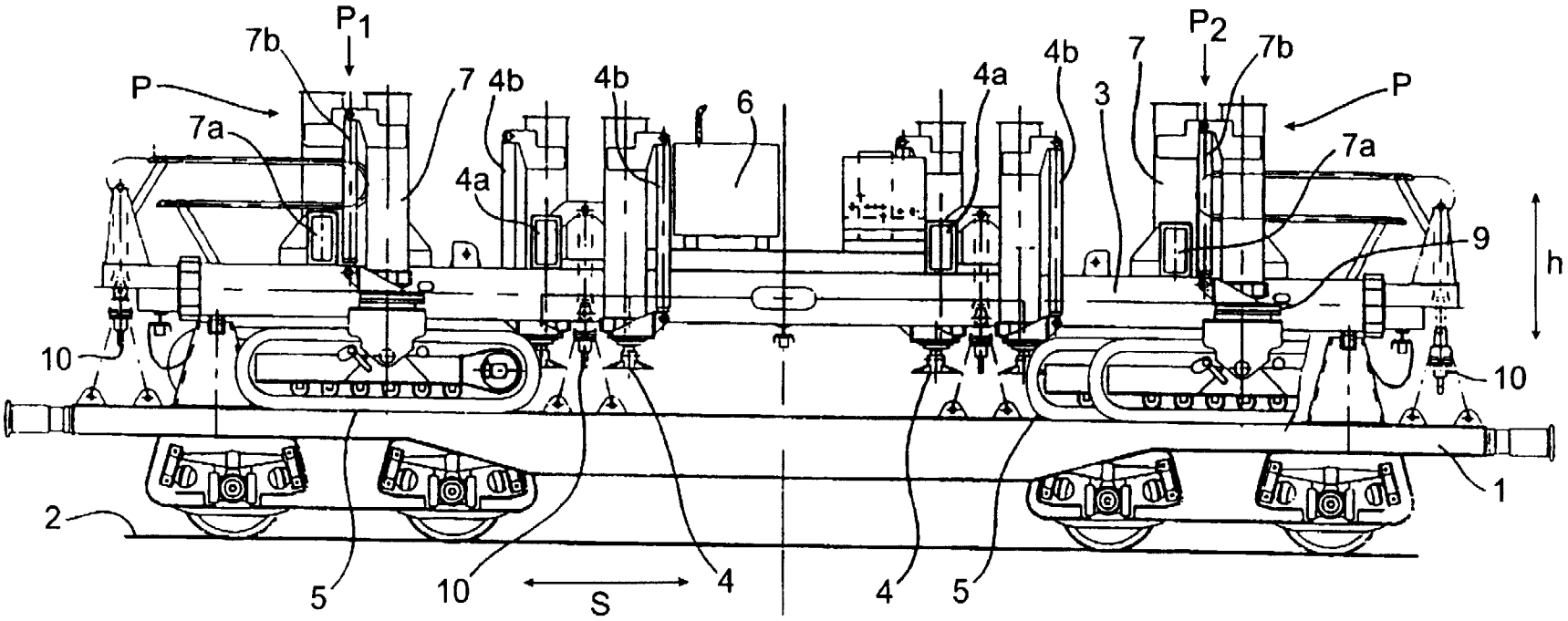
FIG. 1 shows a side view of one preferred lifting device of the invention mounted on a transport platform.
Figure 2:
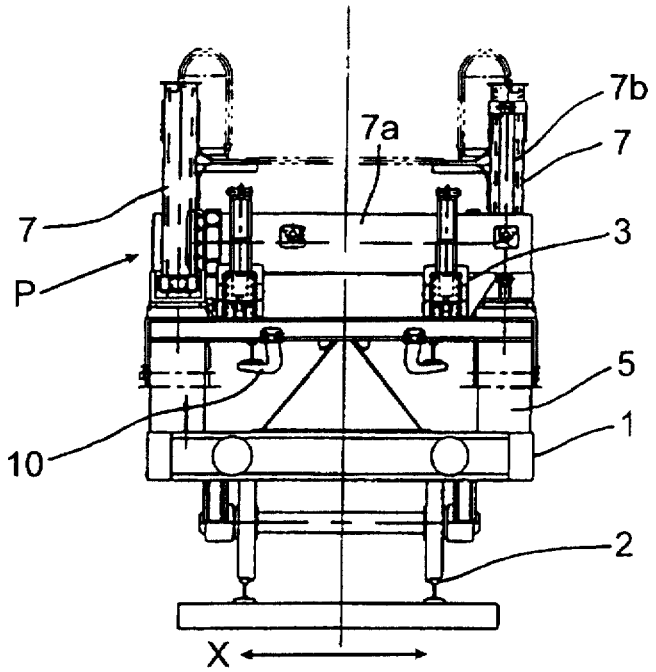
FIG. 2 is an end view of a corresponding lifting device.

Referring to FIGS. 1 and 2, a lifting device intended for manipulation of a track element is transported to a manipulating location on a transport platform 1 included in a transport vehicle. The lifting device is intended, alone or together with another or with a plurality of lifting devices, for handling one or a plurality of track elements at a manipulating location in vertical and horizontal direction above a track 2 by means of lifting elements 4 and transfer elements 5, included in a lifting device frame 3 and operated by an auxiliary force, preferably a pressure medium. For this purpose, the frame 3 is further provided with power and drive means 6, such as a hydraulic gear and a control center or the like. As shown in FIG. 1, frame 3 is provided with at least one, preferably two successive pairs $p_1$, $p_2$ of support members 7 in a longitudinal direction s of the frame, the members being extendable in a transverse direction x of frame 3 and provided with the transfer elements 5, such as wheels, crawlers or the like, for carrying the frame on the ground. Thus, in view of extending the support members 7, the frame 3 is provided in each pair $p_1$, $p_2$ with substantially transverse telescopic arms 7*a*, mounted successively in the longitudinal direction s of frame 3 and placed on top of the lengthwise frame 3. The lifting elements 4, capable of supporting, lifting and lowering the entire lifting device, are also connected to transverse telescopic arms 4*a* mounted on top of the frame 3 for shifting the elements in lateral direction.

FIGS. 1 and 2 further illustrate laterally movable grippers 10 mounted below the lengthwise frame 3 for gripping the track elements to be handled.

In the transport condition, as shown in FIG. 2, the transfer elements 5 for a lifting device placed on the transport platform 1 are in a retracted condition on top of the transport platform 1 and extendable beyond the transport platform 1 for the operating condition. According to FIGS. 3–5, a pair p, consisting of support members 7 mounted on the opposite sides of the frame of the lifting device, is secured to the lifting device frame 3 by means of a common subframe 8, connecting the successively situated telescopic arms 7*a* for an integral frame structure. The subframe is movably mounted on the frame 3 to enable joint action, such as a tilting action wx, ws and/or a rotating action wz for the pair p of support members 7. Thus, the frame 3 extends below frame structures comprising the telescopic arms 7*a* of successive pairs $p_1$, $p_2$.

Figure 3:
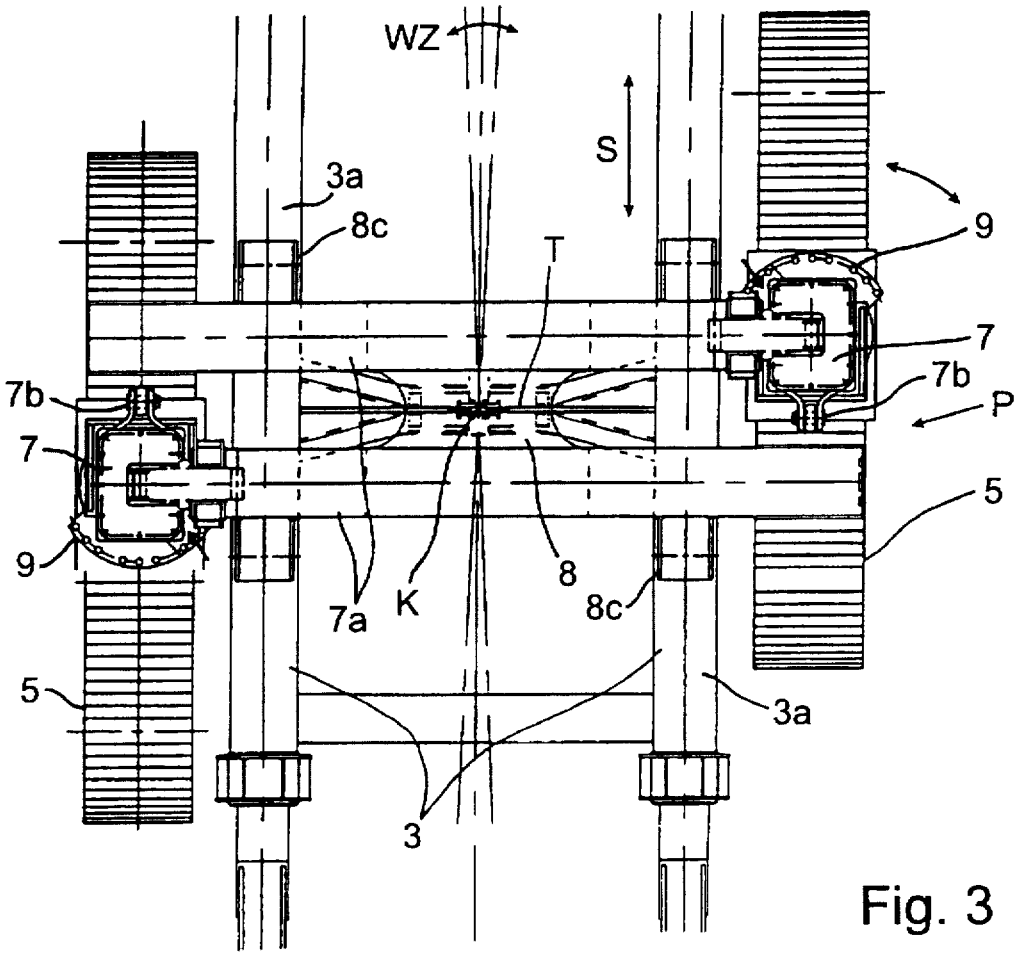
FIG. 3 is a plan view of a pair consisting of support members.
Figure 4:
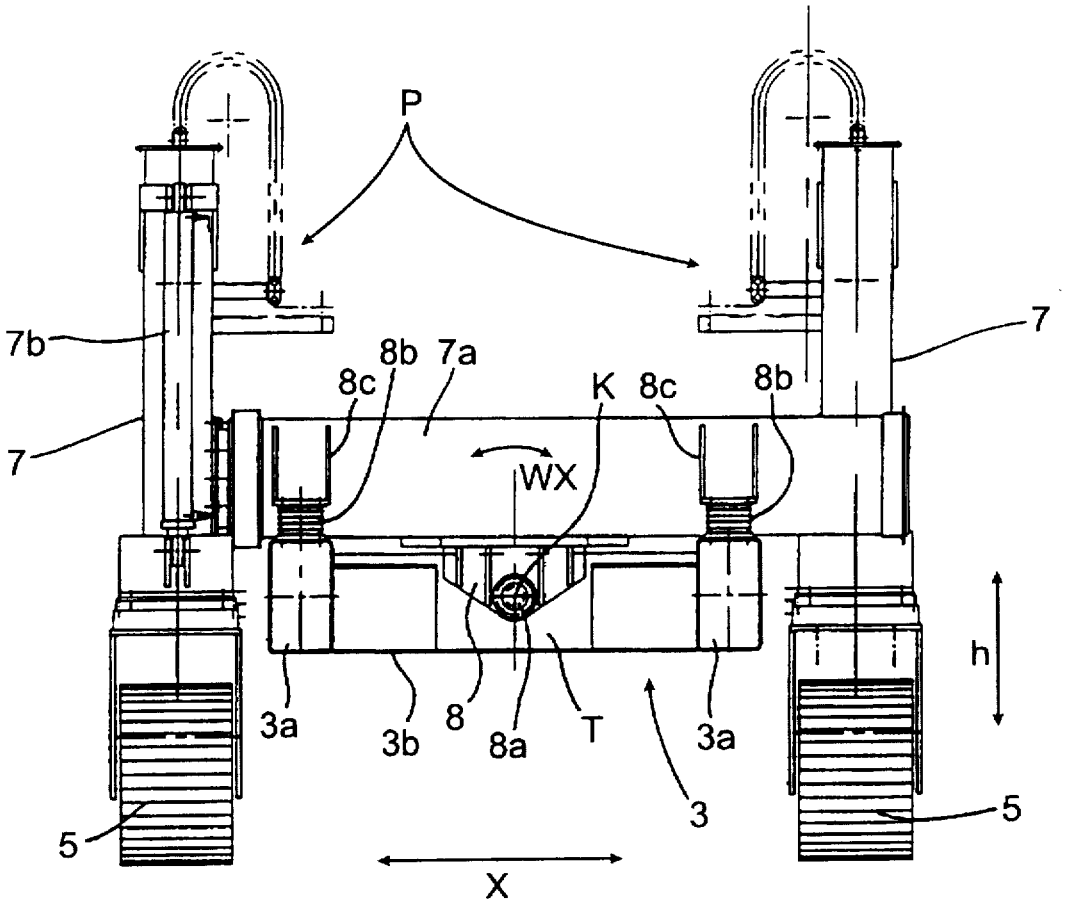
FIG. 4 discloses a corresponding pair in an end view.
Figure 5:
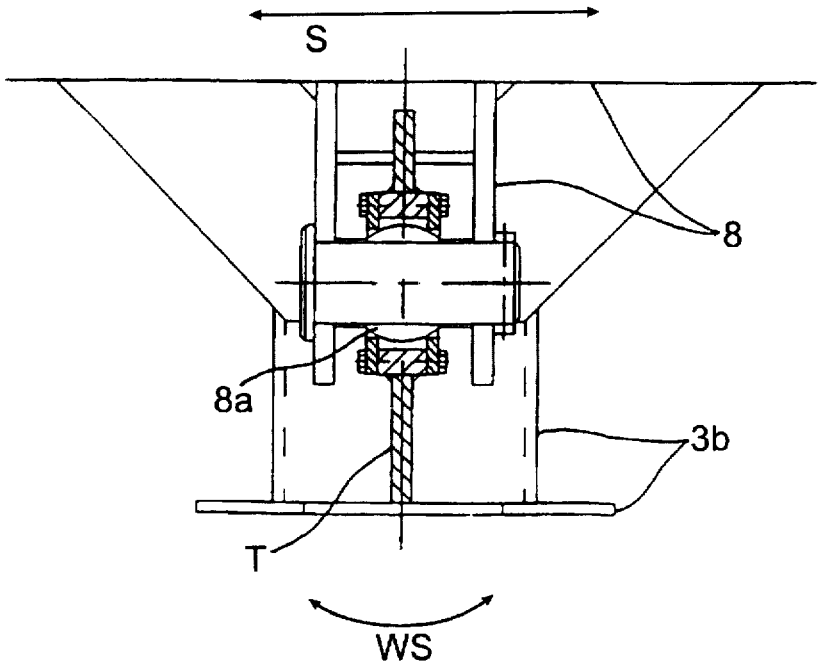
FIG. 5 is a cross-sectional view of a bracing element arrangement used in the above-mentioned pair.

Referring particularly to FIGS. 3–5, the transfer elements 5 for the lifting device are adapted to be movable relative to support members 7 by means of elevating members 7*b*, fitted between support members 7 and transfer elements 5, by moving the transfer elements 5 in a substantially vertical direction h, e.g. for changing the ground clearance of the lifting device frame 3. In addition, and especially in reference to FIG. 3, the lifting device includes directional elements 9 for enabling the rotation of transfer elements 5 in the horizontal plane and locking the same in a new position for replacing the traveling direction of the lifting device with a direction different from the longitudinal direction s of the lifting device. For example, the crawlers serving as transfer elements can be turned to a right angle relative to the longitudinal direction s, whereby the lifting device can travel sideways. The subframe 8 connecting the support members 7 is linked in a force-transmitting fashion to the lifting device frame 3 by means of a brace element 8*a*, supporting in substantially vertical direction h the pair p formed by support members 7 and enabling its tilting action wx, ws and rotating action wz. Thus, the frame 3 is capable of tilting about two horizontal axes perpendicular to each other and rotating in horizontal plane about a vertical axis relative to subframe 8. Especially with reference to FIG. 5, brace element 8*a* comprises a ball joint, which is located at the center point K of the pair p comprising support members 7 substantially on the center axis of the lifting device.

As shown in FIG. 4, the subframe 8 is fastened by, for example, welding to the bottom surface of telescopic arms 7*a*, whereby the pair p of support members 7 is braced to the lifting device by means of a ball joint 8*a* fitted between subframe 8 and a backing frame T included in the lifting device frame 3.

Especially with reference to FIGS. 3 and 4, the lifting device frame 3 includes two primary beams 3*a*, spaced from each other and extending substantially in the longitudinal direction s of the lifting device, the beams being linked to each other by one or a plurality of secondary beams 3*b* extending in a transverse direction x. Thus, the ball joint 8*a* is supported on the transverse backing frame T bracing against the center point of the secondary beam 3*b* linking the primary beams 3*a* in the lifting device frame 3.

In a further embodiment, at least one pair p of support members 7 is coupled to the lifting device frame 3 by means of at least one elastic element 8*b* enabling the tilting action wx, ws and/or rotating action wz for the pair p relative to the lifting device frame 3. The elastic element 8*b* is preferably self-operated by a spring force whereby, on the one hand, it enables the movement of the pair p formed by support members 7 and, on the other hand, tends to reassume its original position of the pair p relative to the lifting device frame 3.

In a further embodiment, the elastic element 8*b* comprises preferably a rubber or metal spring or the like for enabling the tilting action ws, wx and rotating action wz for the pair p, the spring urging progressively, i.e. by a force proportional to the amount of deflection of the pair, to reassume the original position of the pair. Especially with reference to FIGS. 3 and 4, the pair p formed by support members 7 is provided with four elastic elements 8*b* which are mounted at corners essentially on each side of the lifting device. In the illustrated embodiment, the elastic elements 8*b* are placed away from the pair p in opposite directions in the longitudinal direction s, more particularly between primary beams 3*a* and brackets 8*c* extending from its telescopic arms 7*a*.

Figure 6:
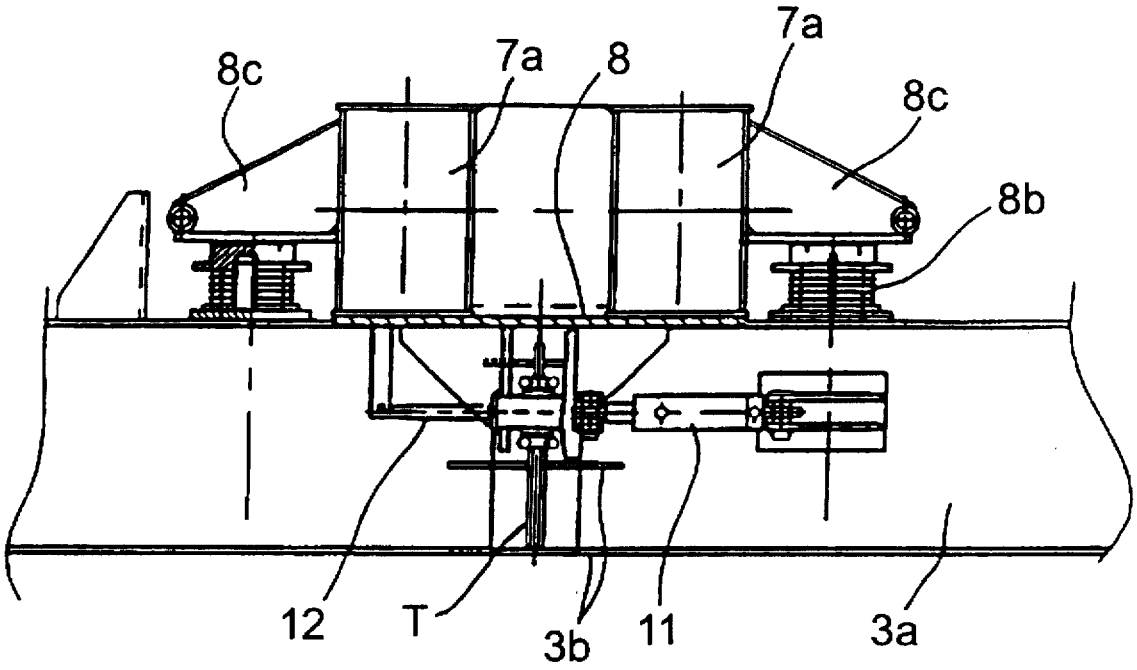
FIG. 6 shows a longitudinal section of one preferred control alternative for a lifting device.

The change of direction for transfer elements 5 can also be effected by means of hydraulic cylinders, as shown in FIG. 6. The top surface of elastic elements 8*b* mounted below the brackets 8*c* is provided with plastic slide plates, enabling the sliding thereof relative to telescopic arms 7*a*. The springs are held in position by means of pins secured to the top surface of primary beams 3*a*.

The pair p is turned in horizontal plane relative to the frame 3 by means of two hydraulic cylinders 11 fitted between primary beams 3*a* and subframe 8, the cylinders being controlled by means of a single control valve. The system includes also a linear gauge transducer 12 providing continuously information about the position of the pair p of support members 7 and, as a consequence, that of transfer elements 5 relative to frame 3. The hydraulic valve receives the control information from a joystick included in the operator's controller and also from the linear transducer. By comparing such information, the system automatically urges to maintain the direction of the transfer elements, such as crawlers, in the direction corresponding to the control stick.

It is obvious that a lifting device of the invention is not limited to the above-described embodiments but can be subjected to major modifications within the scope of the basic idea. Naturally, a lifting device of the invention can be fitted with separate flanged wheels for transferring the lifting device onto an existing track, whereby a track element to be removed can be supported against the wheels. It is not absolutely necessary to provide the lifting device of the invention with separate lifting elements 4 as shown in FIG. 11, which are braced on the ground and operated in a vertical direction relative to the frame 3 by means of lifting cylinders 4*b*. The lifting action effected by lifting elements 4 can be replaced by providing a more extensive movement in the vertical direction for the elevating members 7*b*, such as hydraulic cylinders, which operates the transfer elements 5. In this case, however, it is not possible to brace the lifting device solidly on the ground, for example, in such a manner that it would be possible to transfer the lifting device in a lateral direction by supporting the lifting device alternately on lifting elements 4 and transfer elements 5. In addition, the separate lifting cylinders 4*b* enable that the directional elements 9 of transfer elements 5 be re-directed while the lifting device is supported upon the lifting cylinders.

Naturally, when the same working operation is performed by using two or more lifting devices, the lifting devices are preferably adapted to operate on a so-called slave linkage, whereby a single action of a lifting device is used for passively controlling the other lifting devices. Such arrangements can be adapted to operate on, for example, a transceiver principle or in a corresponding fashion.

We claim:

1. A lifting device for manipulating a track element at a manipulating location at least partially above a track, said lifting device capable of being transported to a manipulating location on a transport platform of a transport vehicle, said lifting device comprising:

a lifting device frame provided with power and drive means;

lifting elements, supported by said lifting device frame, for lifting said track element;

transfer elements for moving said lifting device frame;

at least one pair of support members for supporting and manipulating said transfer elements, said support members being mounted on a common subframe;

at least one brace element for movably mounting said common subframe to said lifting device frame, said at least one brace element allowing said subframe to tilt and rotate with respect to said lifting device frame;

each of said support members having telescopic arms, said telescopic arms having a retracted position in which said transfer elements are retractable essentially upon the transport platform and an extended position in which said transfer elements are extended substantially beyond the transport platform; and each of said support members having elevating means, operating in a substantially vertical direction, for moving said transfer elements in a vertical direction for at least changing ground clearance of said transfer elements; and each of said support members having directional elements for rotating the transfer elements in a substantially horizontal plane for changing the traveling direction of the lifting device.

2. A lifting device as set forth in claim 1, wherein said brace element comprises at least one ball joint which is fitted at the center point of said pair of support members substantially on the center axis of the lifting device frame.

3. A lifting device as set forth in claim 1, wherein said subframe is fastened to the bottom surface of the telescopic arms, whereby said pair of support members is at least partially braced to the lifting device by the brace element fitted between the subframe and a backing frame included in the lifting device frame.

4. A lifting device as set forth in claim 1, wherein said pair of support members is at least partially coupled to the lifting device frame by at least one elastic element enabling the tilting action and the rotating action for said pair of support members relative to the lifting device frame.

5. A lifting device as set forth in claim 4, wherein said elastic element is adapted to be self-operated by a spring force whereby, on the one hand, it enables the movement of the pair of the support members and, on the other hand, urges to reassume the original, adjustable position of said pair of support members relative to the lifting device frame.

6. A lifting device as set forth in claim 1, wherein an actuator is fitted between the frame and the subframe for controlling said transfer elements.

7. A lifting device for manipulating a track element at a manipulating location at least partially above a track, said lifting device capable of being transported to a manipulating location on a transport platform of a transport vehicle, said lifting device comprising:

a lifting device frame including power and drive means;

lifting elements, supported by said lifting device frame, for lifting said track element;

transfer elements for moving said lifting device frame;

at least one pair of support members for supporting and manipulating said transfer elements, said support members being mounted on a common subframe;

each of said support members having telescopic arms, said telescopic arms having a retracted position in which said transfer elements are retractable essentially upon the transport platform and a extended position in which said transfer elements are extended substantially beyond the transport platform;

each of said support members having elevating means, operating in a substantially vertical direction, for moving said transfer elements in a vertical direction for at least changing ground clearance of said transfer elements;

and wherein said pair of support members is at least partially coupled to the lifting device frame by at least one elastic element enabling the tilting and rotating of said pair of support members relative to the lifting device frame and said elastic element is self-operated by means of a spring member.

8. A lifting device for manipulating a track element at a manipulating location at least partially above a track, said lifting device capable of being transported to a manipulating location on a transport platform of a transport vehicle, said lifting device comprising:

a lifting device frame provided with power and drive means;

lifting elements, supported by said lifting device frame, for lifting said track element;

transfer elements for moving said lifting device frame;

at least one pair of support members for supporting and manipulating said transfer elements, said support members being mounted on a common subframe;

at least one brace element for movably mounting said common subframe to said lifting device frame, said at least one brace element allowing said subframe to tilt and rotate with respect to said lifting device frame;

each of said support members having telescopic arms, said telescopic arms having a retracted position in which said transfer elements are retractable essentially upon the transport platform and an extended position in which said transfer elements are extended substantially beyond the transport platform; and each of said support members having directional elements for rotating the transfer elements in a substantially horizontal plane for changing the traveling direction of the lifting device.

* * * * *